US007903059B2

(12) United States Patent
Chiou et al.

(10) Patent No.: US 7,903,059 B2
(45) Date of Patent: Mar. 8, 2011

(54) LIGHTING EMITTING DISPLAY, PIXEL CIRCUIT AND DRIVING METHOD THEREOF

(75) Inventors: Yu-Wen Chiou, Sinshih Township, Tainan County (TW); Chin-Tien Chang, Sinshih Township, Tainan County (TW); Hong-Ru Guo, Sinshih Township, Tainan County (TW)

(73) Assignee: Himax Technologies Limited, Tainan (TW)

( * ) Notice: Subject to any disclaimer, the term of this patent is extended or adjusted under 35 U.S.C. 154(b) by 842 days.

(21) Appl. No.: 11/717,104

(22) Filed: Mar. 13, 2007

(65) Prior Publication Data

US 2007/0210998 A1 Sep. 13, 2007

(30) Foreign Application Priority Data

Mar. 13, 2006 (TW) ..... 95108476 A

(51) Int. Cl.
*G09G 3/32* (2006.01)

(52) U.S. Cl. ..... 345/82

(58) Field of Classification Search ..... 345/76, 345/77, 78, 82, 83
See application file for complete search history.

(56) References Cited

U.S. PATENT DOCUMENTS

| | | | | |
|---|---|---|---|---|
| 6,373,454 | B1 * | 4/2002 | Knapp et al. | 345/76 |
| 6,909,409 | B2 * | 6/2005 | Tanada | 345/51 |
| 7,123,044 | B2 * | 10/2006 | Orii et al. | 324/770 |
| 7,274,151 | B2 * | 9/2007 | Wakou et al. | 315/169.3 |
| 7,414,599 | B2 * | 8/2008 | Chung et al. | 345/76 |
| 7,646,367 | B2 * | 1/2010 | Kimura | 345/82 |
| 2005/0083270 | A1 * | 4/2005 | Miyazawa | 345/76 |
| 2005/0168416 | A1 * | 8/2005 | Hashimoto et al. | 345/76 |
| 2005/0285825 | A1 * | 12/2005 | Eom et al. | 345/76 |
| 2006/0007072 | A1 * | 1/2006 | Choi et al. | 345/76 |

* cited by examiner

*Primary Examiner* — Chanh Nguyen
*Assistant Examiner* — Jeffrey Parker
(74) *Attorney, Agent, or Firm* — Bacon & Thomas, PLLC

(57) ABSTRACT

A lighting emitting display, a pixel circuit and a driving method thereof. The pixel circuit includes a driving transistor, a capacitor and a LED. The capacitor receives a first supply voltage and is coupled to a gate of the driving transistor. A cathode of the LED receives a second supply voltage. During a pre-charge period, the gate and the drain of the driving transistor are coupled to an anode of the LED, the source of the driving transistor is coupled to a charging voltage. The source of the driving transistor receives a data signal and the drain and gate of the driving transistor are coupled to each other during a programming period. The source of the driving transistor is coupled to receive the first supply voltage and the drain of the driving transistor is coupled to the anode of the LED during a display period.

7 Claims, 13 Drawing Sheets

LIGHTING EMITTING DISPLAY, PIXEL CIRCUIT AND DRIVING METHOD THEREOF

This application claims the benefit of Taiwan application Serial No. 95108476, filed Mar. 13, 2006, the subject matter of which is incorporated herein by reference.

BACKGROUND OF THE INVENTION

1. Field of the Invention

The invention relates in general to a display, a pixel circuit and a driving method thereof, and more particularly to a lighting emitting display, a pixel circuit of a light emitting diode (LED) and a driving method thereof.

2. Description of the Related Art

An organic light emitting display has no limitation to the viewing angle, has the low power consumption, may be easily manufactured and has the high response speed, so the organic light emitting display has become the next generation of the display technology. In the organic light emitting display, an organic film is evaporated between a transparent anode and a metal cathode, and electrons and holes are introduced between the transparent anode and the metal cathode to combine together between the organic films so that the energy can be converted into visible light. In addition, different organic materials may be used to output the light with different colors so that the requirement of the full-color display may be satisfied.

In a pixel circuit of the organic light emitting display, the luminance outputted from the pixel may be different from an expected one due to the threshold voltage variation of each MOS transistor and the influence of the mobility shift. Thus, it is very important to compensate the pixel structure or the driving method in the above-mentioned state. FIG. 1 (PriorArt) shows a conventional pixel circuit 100 capable of compensating a mobility shift. Referring to FIG. 1, the pixel circuit 100 includes transistors K1 to K5, a capacitor Cst and an organic light-emitting diode O1. In the pixel circuit 100, the transistors K2 and K4 form a current mirror to control the current flowing through the organic light-emitting diode O1. However, the dismatch between the transistors K2 and K4 may make the behavior of the pixel be worse than the expected behavior.

FIG. 2 (Prior Art) shows another conventional pixel circuit 200 capable of compensating the mobility shift. Referring to FIG. 2, the pixel circuit 200 includes transistors T1 to T7, a capacitor C and an organic light-emitting diode OLED. Compared with the pixel circuit of FIG. 1, the problem of dismatch between the transistors K2 and K4 can be overcome, but the number of transistors in the pixel circuit 200 is greater than that in the pixel circuit 100. So, the aperture ratio is influenced and the cost is increased.

SUMMARY OF THE INVENTION

The invention is directed to an organic light emitting display, a pixel circuit and a driving method thereof capable of preventing the problems of the increase of the cost and the decrease of the aperture ratio, which are caused by the circuit dismatch and the too many transistors.

According to a first aspect of the present invention, a pixel circuit of a light emitting diode (LED) is provided. The pixel circuit includes a driving transistor, a capacitor and a light emitting diode (LED). The capacitor has one end coupled to receive a first supply voltage and the other end coupled to a gate of the driving transistor. The LED has a cathode coupled to receive a second supply voltage. The gate and the drain of the driving transistor are coupled to an anode of the LED, and the source of the driving transistor is coupled to a charging voltage during a pre-charge period. The gate and the drain of the driving transistor are commonly coupled to an anode of the light emitting diode, and the source of the driving transistor is coupled to receive a charging voltage during a pre-charge period. The source of the driving transistor is coupled to receive a data signal and the drain and gate of the driving transistor are coupled to each other during a programming period. The source of the driving transistor is coupled to receive the first supply voltage and the drain of the driving transistor is coupled to the anode of the light emitting diode during a display period.

The invention will become apparent from the following detailed description of the preferred but non-limiting embodiments. The following description is made with reference to the accompanying drawings.

DETAILED DESCRIPTION OF THE INVENTION

Figure 1:
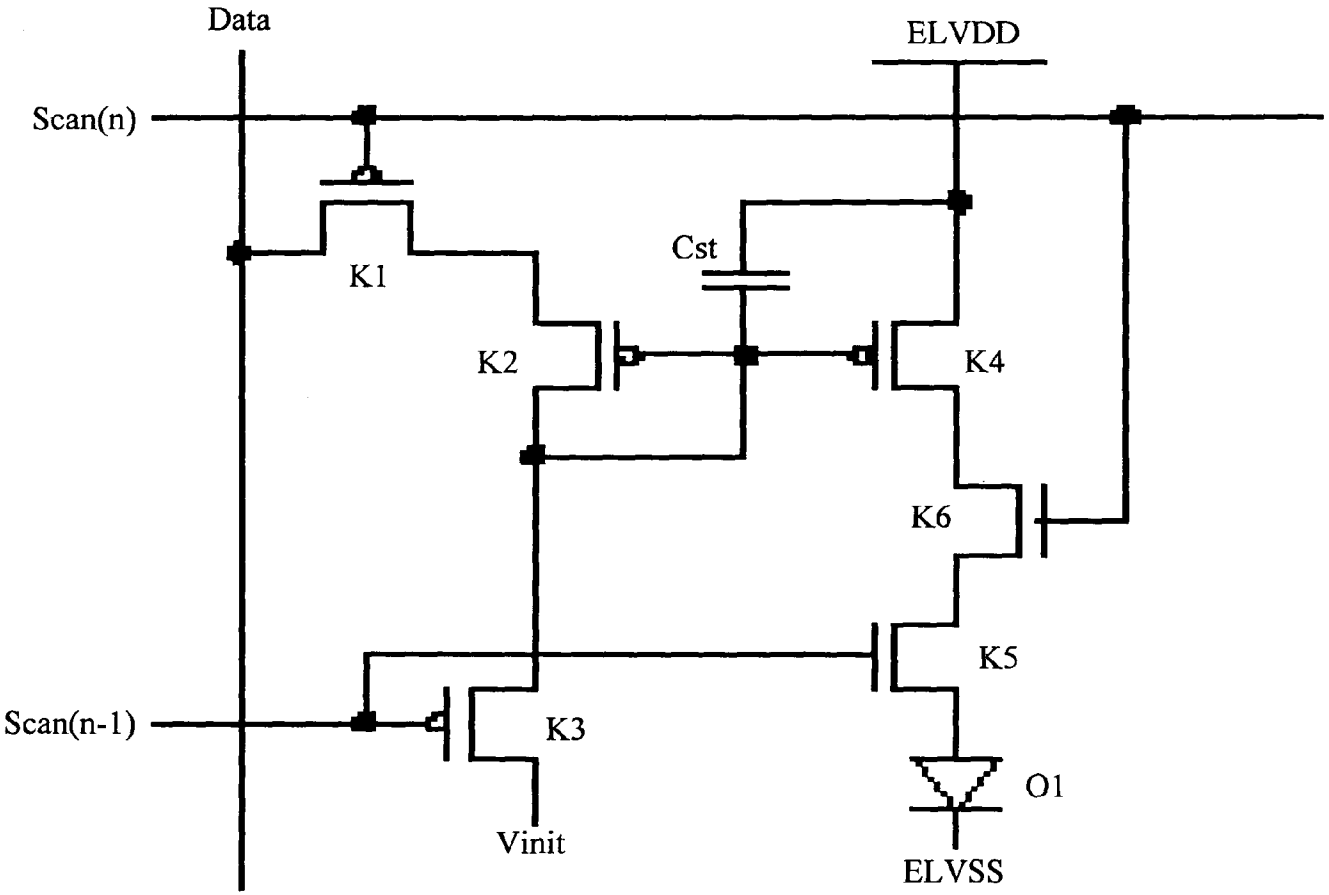
FIG. 1(PRIOR ART)
FIG. 1 (Prior Art) shows a conventional pixel circuit capable of compensating a mobility shift.
Figure 2:
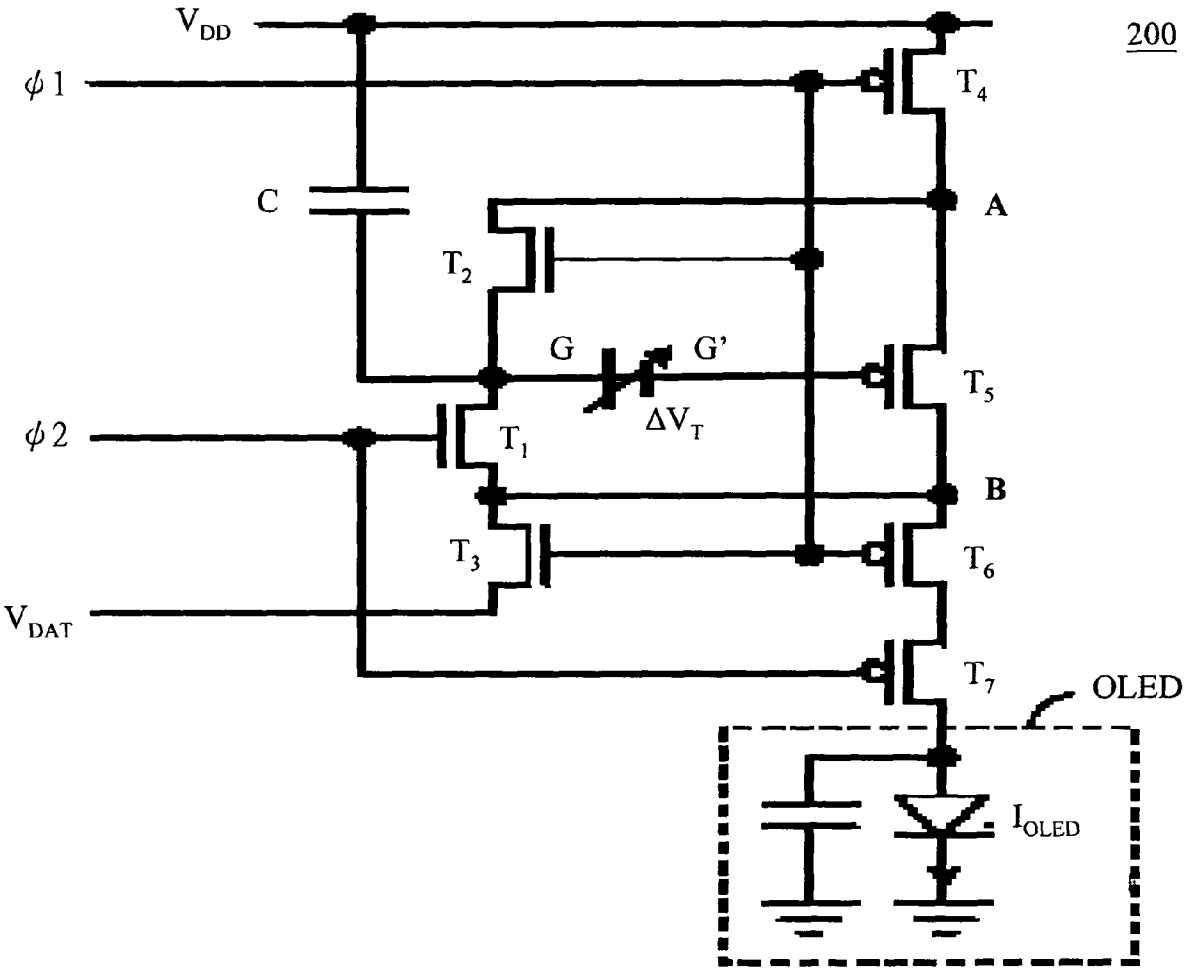
FIG. 2(PRIOR ART)
FIG. 2 (Prior Art) shows another conventional pixel circuit capable of compensating a mobility shift.
Figure 3:
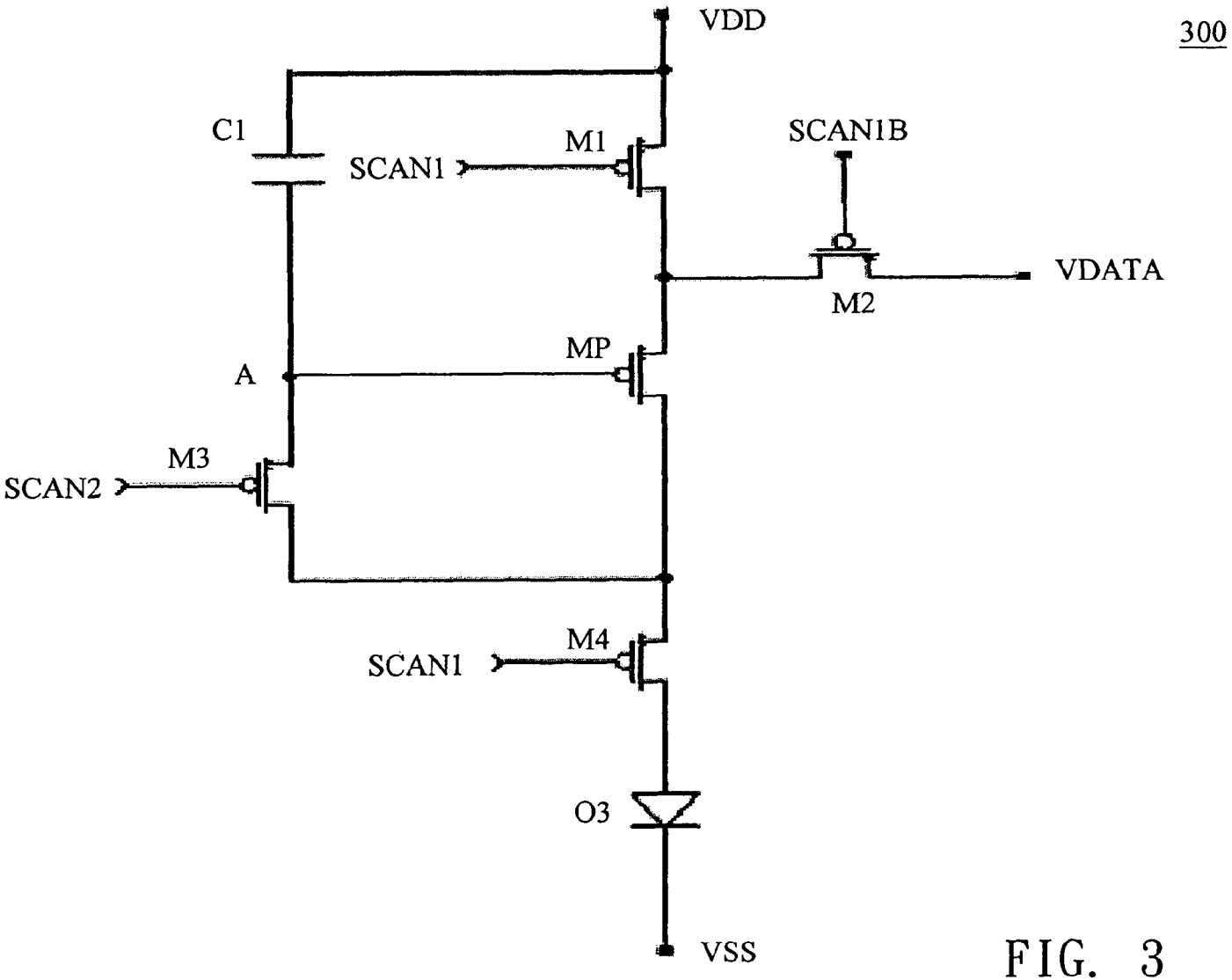
FIG. 3 shows a pixel circuit of an organic light-emitting diode according to a first embodiment of the invention.

FIG. 3 shows a pixel circuit 300 of an organic light-emitting diode according to a first embodiment of the invention. Referring to FIG. 3, the pixel circuit 300 includes a driving transistor, for example PMOS transistor MP, a capacitor C1, an organic light-emitting diode O3 and switches M1 to M4. The capacitor C1 is coupled between a first supply voltage VDD and a gate of the PMOS transistor MP. A cathode of the organic light-emitting diode O3 is coupled to a second supply voltage VSS.

The switch M1 is coupled between a source of the PMOS transistor MP and the first supply voltage VDD. The switch M2 is coupled between the source of the PMOS transistor MP and a data signal. The switch M3 is coupled between the gate and a drain of the PMOS transistor MP. The switch M4 is coupled between the drain of the PMOS transistor MP and an anode of the organic light-emitting diode O3.

Figure 4:
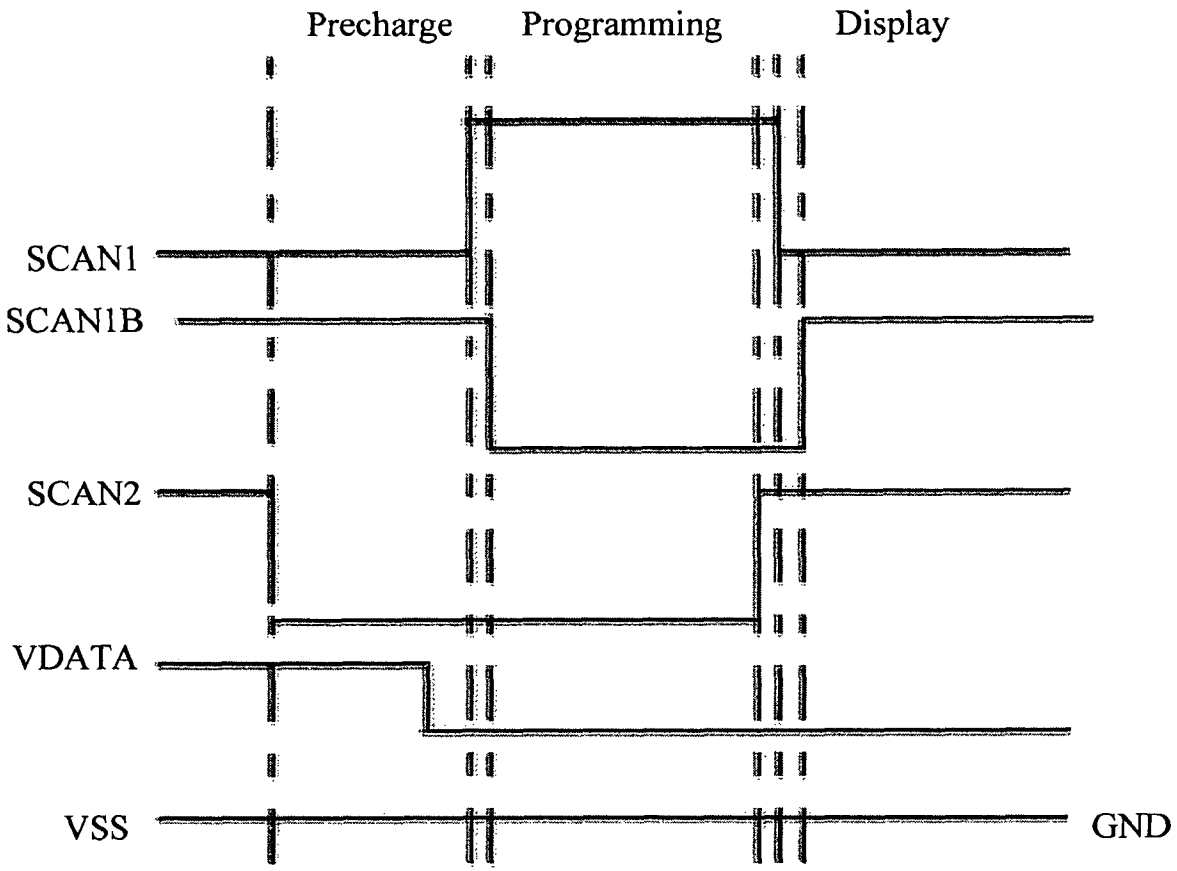
FIG. 4 shows waveforms of driving signals in one example of the pixel circuit according to the first embodiment of the invention.

FIG. 4 shows waveforms of driving signals in one example of the pixel circuit according to the first embodiment of the invention. As shown in FIGS. 3 and 4, the switches M1 to M4 in this embodiment are PMOS transistors. The gate of the switch M1 receives a signal SCAN1 and is controlled to being turned on or off according to the signal SCAN1. The gate of the switch M2 receives a signal SCAN1B and is controlled to being turned on or off according to the signal SCAN1B. The gate of the switch M3 receives a signal SCAN2 and is controlled to being turned on or off according to the signal SCAN2. The gate of the switch M4 receives the signal SCAN1 and is controlled to being turned on or off according to the signal SCAN1. The second supply voltage VSS remains on a constant voltage, such as the ground voltage GND.

During a pre-charge period Precharge, the switch M1 is turned on, the switch M2 is turned off, the switch M3 is turned on and the switch M4 is turned on so that the gate and the drain of the PMOS transistor MP are coupled to the anode of the organic light-emitting diode O3, and the source of the PMOS transistor MP is coupled to a charging voltage, which is provided by the first supply voltage VDD in this embodiment. At this moment, the voltage at a node A is VAini.

During a programming period Programming, the switch M1 is turned off, the switch M2 is turned on, the switch M3 is turned on and the switch M4 is turned off, so that the source of the PMOS transistor MP is coupled to a data signal VDATA, and the drain and the gate of the PMOS transistor MP are coupled to the node A to generate a node voltage VA. The data signal VDATA, the voltage VAini and the threshold voltage Vth of the PMOS transistor MP have the following relationship:

$$VAini+|Vth|<VDATA.$$

Thus, the data signal VDATA can be inputted into the pixel circuit 300. In this case, the data signal VDATA, the node voltage VA and the threshold voltage Vth of the PMOS transistor MP have the following relationship:

$$VA=VDATA-|Vth|.$$

During a displaying period Display, the switch M1 is turned on, the switch M2 is turned off, the switch M3 is turned off, the switch M4 is turned on, the source of the PMOS transistor MP is coupled to the first supply voltage VDD, and the drain of the PMOS transistor MP is coupled to the anode of the organic light-emitting diode O3. At this moment, the current Io of the organic light-emitting diode O3 is as follows:

$$Io=K(|Vgs|-|Vth|)^2,$$

wherein Vgs is a voltage difference between the gate and the source of the PMOS transistor and K is a constant. Also, substitute "Vgs=VDATA−|Vth|−VDD" into the above-mentioned equation can get:

$$Io=K(VDD-VDATA)^2.$$

Thus, the organic light-emitting diode O3 can emit light based on the node voltage VA, and emit light based on the data signal VDATA.

Figure 5:
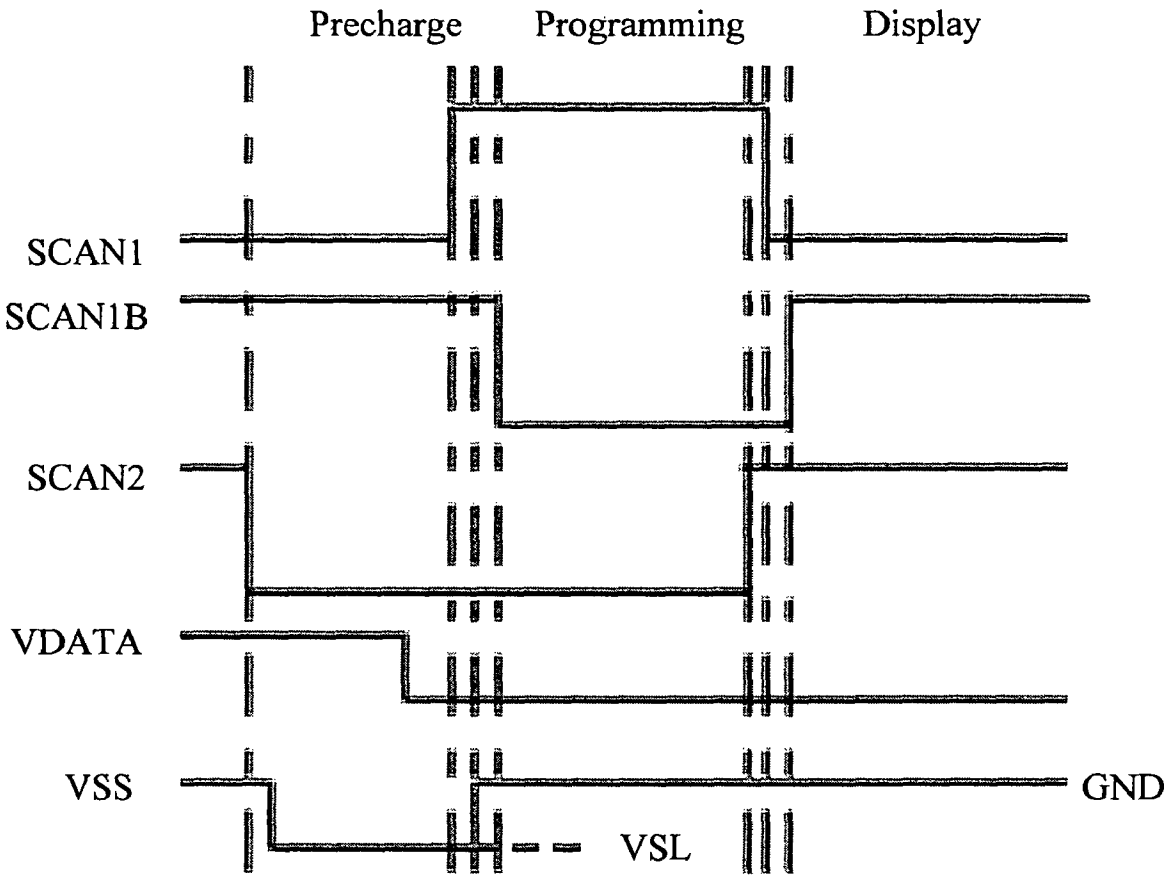
FIG. 5 shows waveforms of driving signals in another example of the pixel circuit according to the first embodiment of the invention.

FIG. 5 shows waveforms of driving signals in another example of the pixel circuit according to the first embodiment of the invention. The difference between FIGS. 5 and 4 is that the second supply voltage VSS does not remain on a constant voltage all the time. In this embodiment, the second supply voltage VSS has a second voltage level, such as the ground voltage GND, during the programming period Programming and the displaying period Display, and is reduced to the first voltage level, such as the voltage VSL, during the pre-charge period Precharge, such that the VAini may become smaller. Then, during the programming period Programming, the voltage level of the data signal VDATA may be configured to be adjustable. The first voltage level is lower than the second voltage level.

Figure 6:
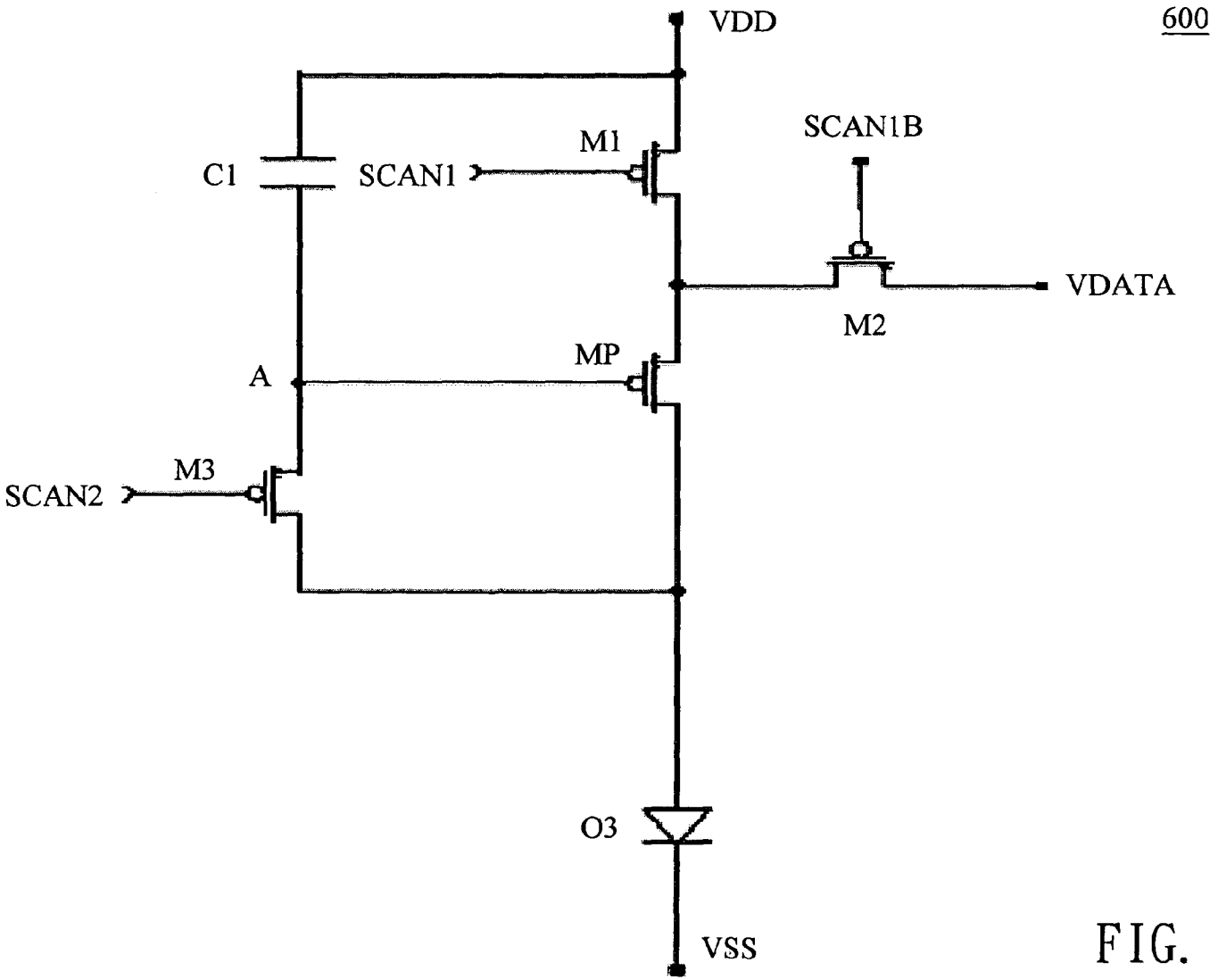
FIG. 6 shows a pixel circuit of an organic light-emitting diode according to a second embodiment of the invention.
Figure 7:
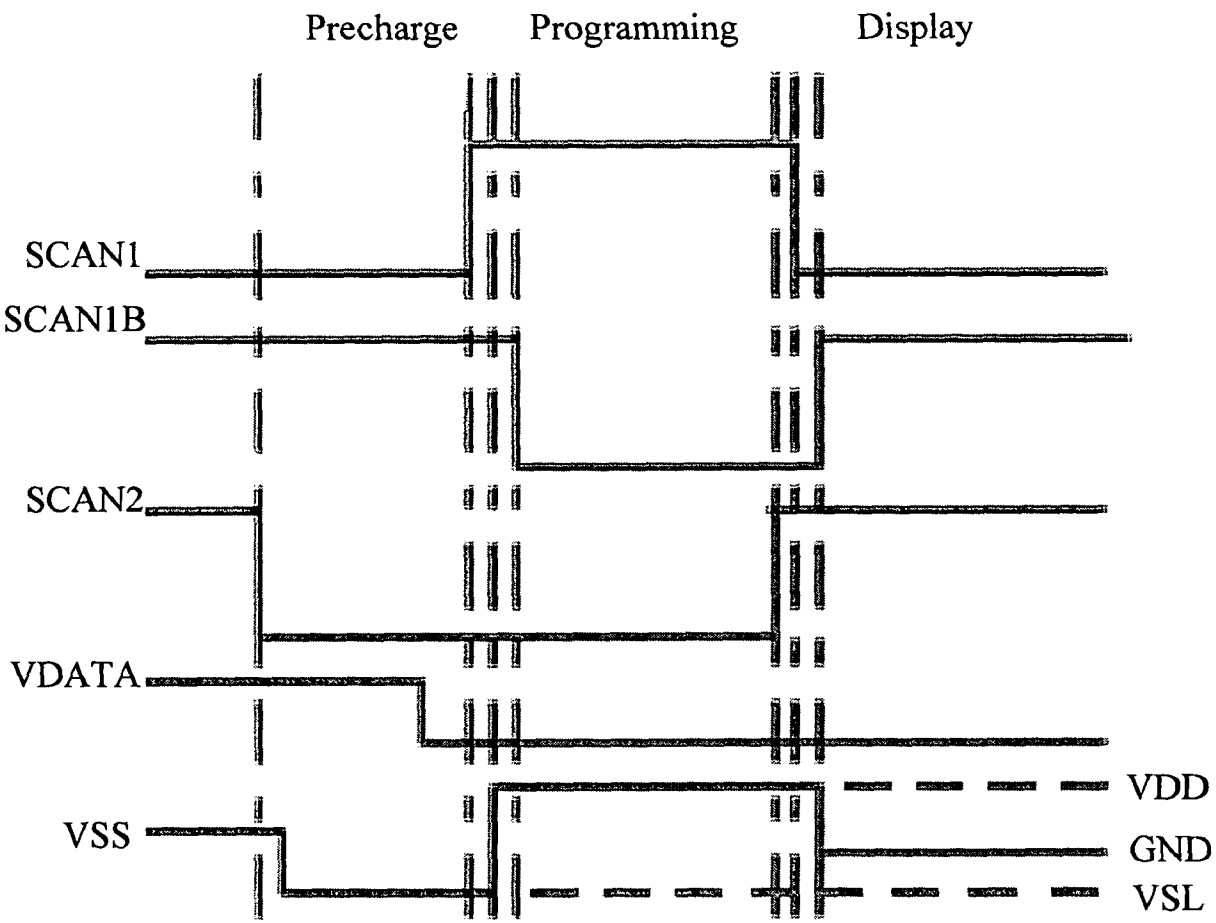
FIG. 7 shows waveforms of driving signals in the pixel circuit according to the second embodiment of the invention.

FIG. 6 shows a pixel circuit 600 of an organic light-emitting diode according to a second embodiment of the invention. As shown in FIG. 6, the difference between the pixel circuit 600 and the pixel circuit 300 is that the pixel circuit 600 does not have the switch M4, and the drain of the PMOS transistor MP is directly coupled to the anode of the organic light-emitting diode O3. FIG. 7 shows waveforms of driving signals in the pixel circuit according to the second embodiment of the invention. Compared with the driving signals of FIG. 5, the second supply voltage VSS is changed to substantially equal to the charging voltage, such as the first supply voltage VDD during the programming period Programming in order to disconnect the drain of the PMOS transistor MP from the anode of the organic light-emitting diode O3 during the programming period Programming when no switch M4 is provided. The second supply voltage VSS is the ground voltage GND during the displaying period Display, and the second supply voltage VSS is the voltage VSL lower than the ground voltage GND during the pre-charge period Precharge.

Figure 8:
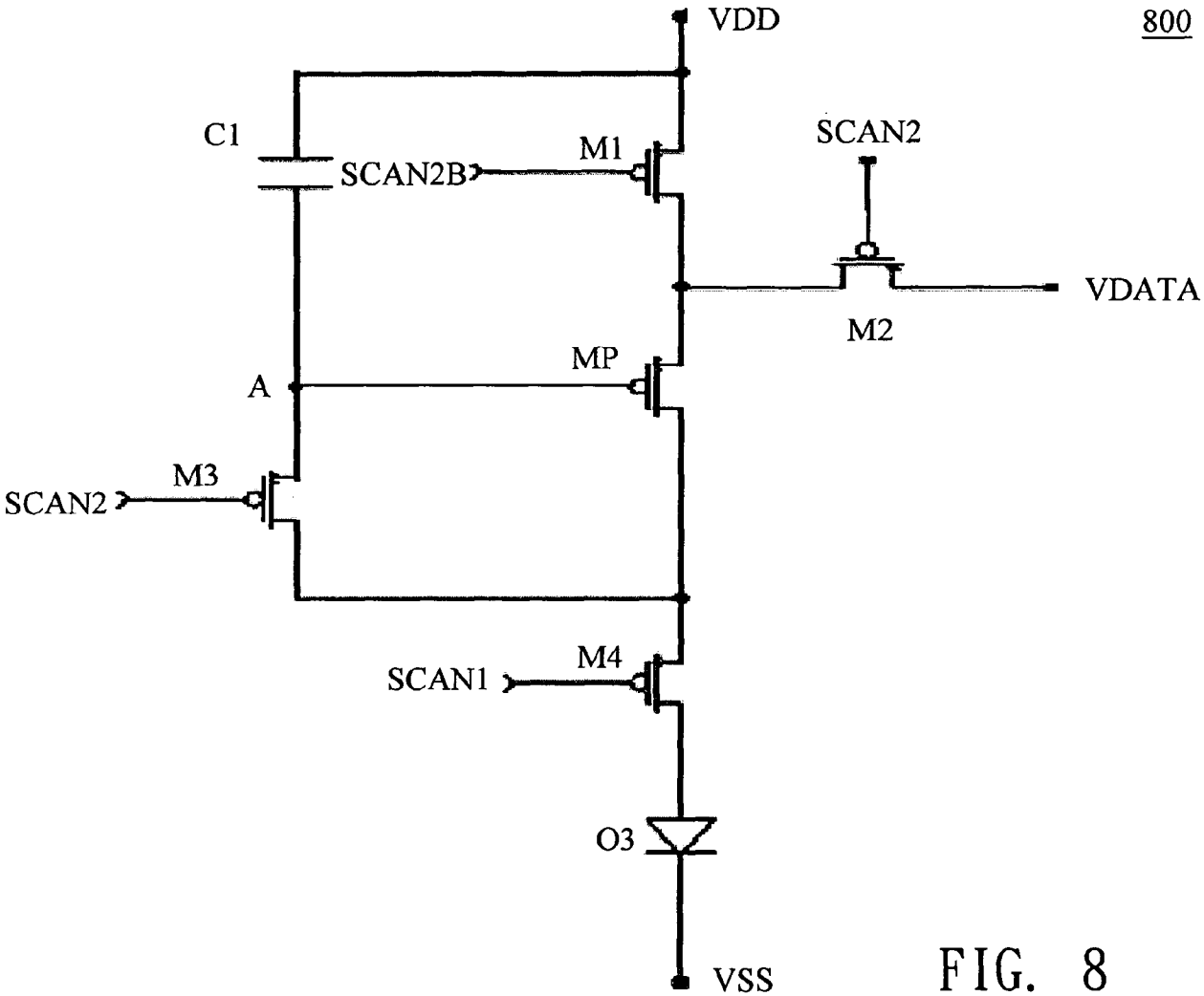
FIG. 8 shows a pixel circuit of an organic light-emitting diode according to a third embodiment of the invention.
Figure 9:
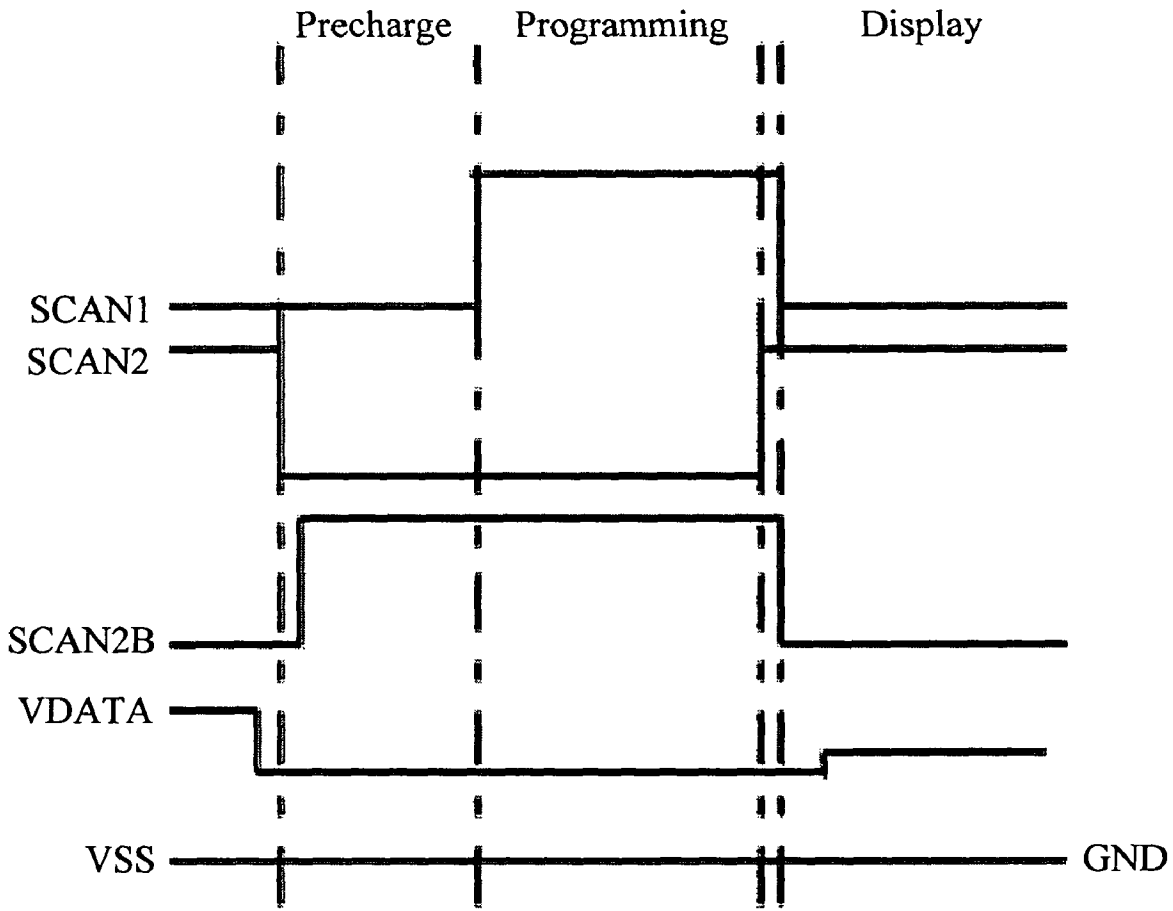
FIG. 9 shows waveforms of driving signals in one example of the pixel circuit according to the third embodiment of the invention.

FIG. 8 shows a pixel circuit 800 of an organic light-emitting diode according to a third embodiment of the invention. As shown in FIG. 8, the difference between the pixel circuit 800 and the pixel circuit of the first embodiment is that the switch M1 is controlled by the signal SCAN2B, and the signal SCAN2B and the signal SCAN2 have opposite phases. Consequently, the switch M1 is turned off during the pre-charge period Precharge, the switch M2 is turned on, and the capacitor C1 is charged by the data signal VDATA (the charging voltage is provided by data signal VDATA) to generate the voltage VAini. FIG. 9 shows waveforms of driving signals in one example of the pixel circuit according to the third embodiment of the invention. The associated driving methods can be derived by one of ordinary skill in the art, so detailed descriptions thereof will be omitted.

Figure 10:
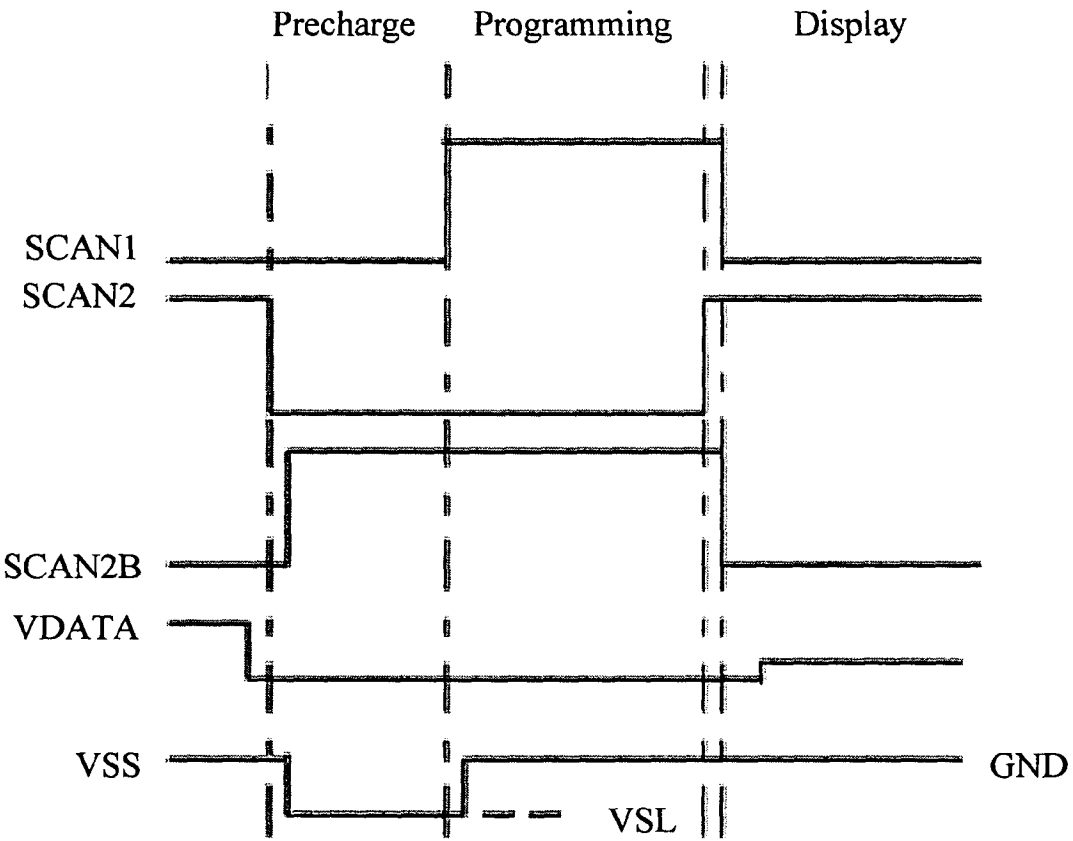
FIG. 10 shows waveforms of driving signals in another example of the pixel circuit according to the third embodiment of the invention.

FIG. 10 shows waveforms of driving signals in another example of the pixel circuit according to the third embodiment of the invention. The difference between FIGS. 10 and 9 is that the magnitude of the second supply voltage VSS is not constant. In this embodiment, the second supply voltage VSS has the second voltage level, such as the ground voltage GND, during the programming period Programming and the displaying period Display, and is changed to the first voltage level, such as the voltage VSL, during the pre-charge period Precharge, so that the VAini may become smaller. Thus, the level of the data signal VDATA is configured to be adjustable during the programming period Programming. The first voltage level is lower than the second voltage level.

Figure 11:
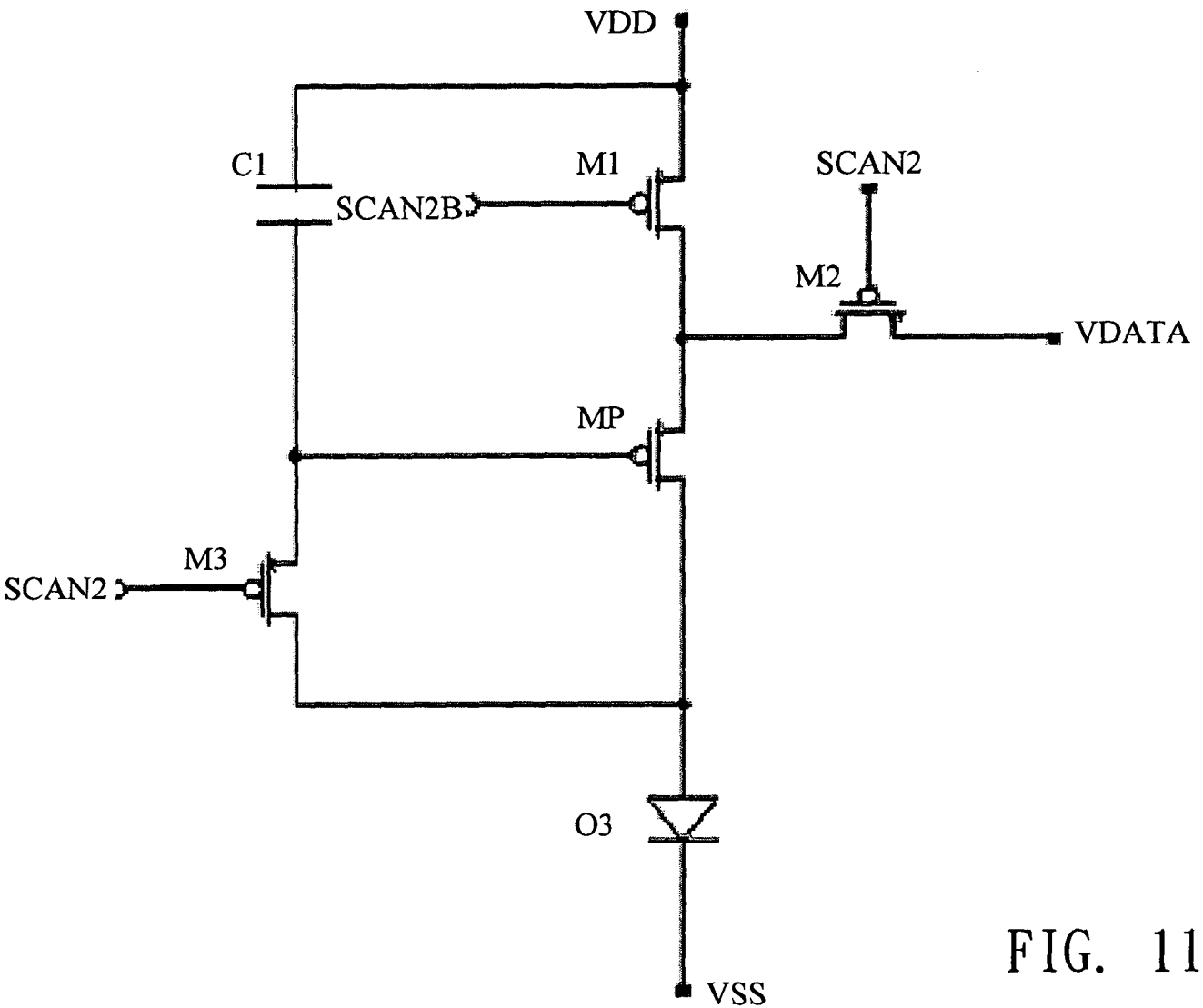
FIG. 11 shows a pixel circuit of an organic light-emitting diode according to a fourth embodiment of the invention.
Figure 12:
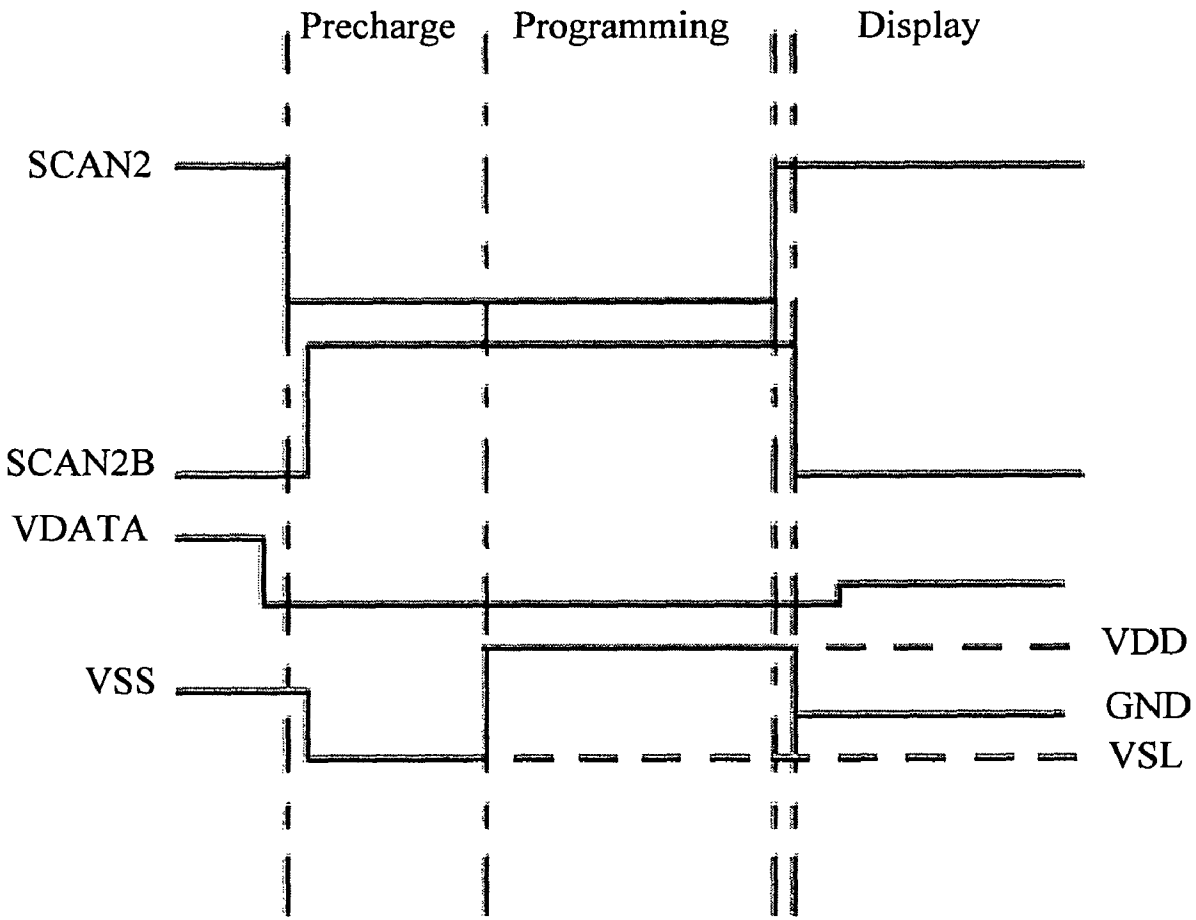
FIG. 12 shows waveforms of driving signals in the pixel circuit according to the fourth embodiment of the invention.

FIG. 11 shows a pixel circuit 110 of an organic light-emitting diode according to a fourth embodiment of the invention. As shown in FIG. 11, the difference between the pixel circuit 110 and the pixel circuit 800 is that the pixel circuit 110 does not have the switch M4 so that the drain of the PMOS transistor MP is directly coupled to the anode of the organic light-emitting diode O3. FIG. 12 shows waveforms of driving signals in the pixel circuit according to the fourth embodiment of the invention. Compared with the driving signals of FIG. 10, the magnitude of the second supply voltage VSS is increased to substantially equal to the magnitude of the charging voltage, such as the first supply voltage VDD during the programming period Programming in order to disconnect the drain of the PMOS transistor MP from the anode of the organic light-emitting diode O3 during the programming period Programming when no switch M4 is provided. The second supply voltage VSS is changed to the ground voltage GND during the displaying period Display, and the second supply voltage VSS is changed to the voltage VSL which is lower than the ground voltage GND during the pre-charge period Precharge.

According to the concept of the invention, all the switches of the pixel circuit may be implemented by NMOS transistors, and controlled by the complementary signals corresponding to the original PMOS transistors without departing from the scope of the invention. Taking the pixel circuit 300 as an example, the switch M2 may be implemented by a NMOS transistor and is controlled by the signal SCAN1.

Figure 13:
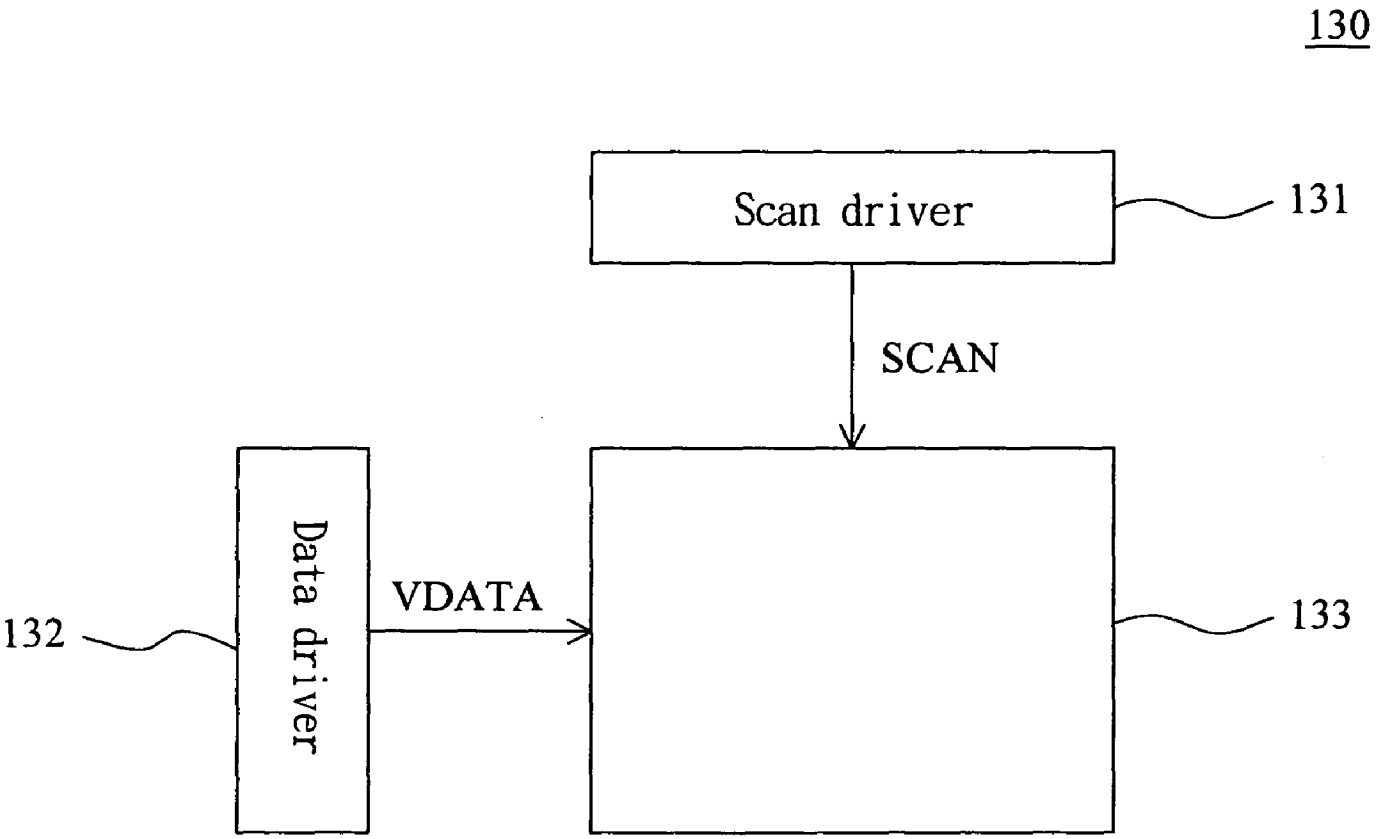
FIG. 13 is a block diagram showing an organic light emitting display according to the invention.

FIG. 13 is a block diagram showing an organic light emitting display 130 according to the invention. Referring to FIG. 13, the display 130 includes a scan driver 131, a data driver 132 and a pixel array 133. The scan driver 131 provides a scan signal SCAN, such as the signal SCAN1, SCAN1B, SCAN2 or SCAN2B, to the pixel array 133. The data driver 132 provides the data signal VDATA to the pixel array 133, which includes the pixel circuit 300, 600, 800 or 110, or the pixel circuit included in the concept of the invention.

In the display, the pixel circuit and the driving method thereof according to the embodiments of the invention, the novel architecture is provided. Thus, the luminance will not be influenced by the dismatch between the MOS transistors, and no extra circuit has to be provided to solve the problem of dismatch. Also, the circuit may be designed flexibly and may be adjusted according to the product under the concept of the invention.

While the invention has been described by way of example and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A pixel circuit, comprising:

a driving transistor;

a capacitor having one end coupled to receive a first supply voltage and the other end coupled to a gate of the driving transistor;

a light emitting diode having a cathode coupled to receive a second supply voltage and having an anode directly coupled to the drain of the driving transistor;

a first switch coupled between the source of the driving transistor and the first supply voltage;

a second switch coupled between the source of the driving transistor and the data signal; and a third switch coupled between the gate of the driving transistor and the drain of the driving transistor;

wherein the gate and a drain of the driving transistor are commonly coupled to an anode of the light emitting diode, and a source of the driving transistor is coupled to receive a charging voltage during a pre-charge period, the source of the driving transistor is coupled to receive a data signal and the drain and gate of the driving transistor are coupled to each other during a programming period, and the source of the driving transistor is coupled to receive the first supply voltage during a display period;

wherein the second supply voltage is independent of pixel data indicated by the data signal; the second supply voltage has a first voltage level during the pre-charge period; the second supply voltage has a second voltage level during the display period and the second supply voltage has a third voltage level during the display period, wherein the third voltage level is between the first and the second voltage levels.

2. The pixel circuit according to claim 1, wherein the first switch is turned on, the second switch is turned off and the third switch is turned on during the pre-charge period, the first switch is turned off, the second switch is turned on and the third switch is turned on during the programming period, and the first switch is turned on, the second switch is turned off and the third switch is turned off during the display period.

3. The pixel circuit according to claim 2, wherein the charging voltage is provided by the first supply voltage during the pre-charge period.

4. The pixel circuit according to claim 1, wherein the first switch is turned off, the second switch is turned on and the third switch is turned on during the pre-charge period, the first switch is turned off, the second switch is turned on and the third switch is turned on during the programming period, and the first switch is turned on, the second switch is turned off and the third switch is turned off during the display period.

5. The pixel circuit according to claim 4, wherein the charging voltage is provided by the data signal during the pre-charge period.

6. The pixel circuit according to claim 1, wherein the driving transistor is a PMOS transistor and the second voltage level is higher than the first voltage level.

7. The pixel circuit according to claim 6, wherein the magnitude of the second supply voltage is substantially equal to the magnitude of the charging voltage during the programming period.

* * * * *